US010415817B2

(12) United States Patent
Myracle

(10) Patent No.: US 10,415,817 B2
(45) Date of Patent: Sep. 17, 2019

(54) DISPLAY KIT

(71) Applicant: Signature Brands LLC, Ocala, FL (US)

(72) Inventor: Robert Gregory Myracle, Orange, VA (US)

(73) Assignee: SIGNATURE BRANDS LLC, Ocala, FL (US)

( * ) Notice: Subject to any disclaimer, the term of this patent is extended or adjusted under 35 U.S.C. 154(b) by 0 days.

(21) Appl. No.: 16/179,365

(22) Filed: Nov. 2, 2018

(65) Prior Publication Data

US 2019/0145617 A1 May 16, 2019

Related U.S. Application Data

(60) Provisional application No. 62/584,567, filed on Nov. 10, 2017.

(51) Int. Cl.

| | |
|---|---|
| ***F21V 33/00*** | (2006.01) |
| ***F21V 7/00*** | (2006.01) |
| *F21W 121/00* | (2006.01) |

(52) U.S. Cl.

CPC ..... *F21V 33/0028* (2013.01); *F21V 7/0008* (2013.01); *F21W 2121/00* (2013.01)

(58) Field of Classification Search

CPC ..... F21V 33/0028

See application file for complete search history.

(56) References Cited

U.S. PATENT DOCUMENTS

| | | | | |
|---|---|---|---|---|
| 6,382,808 | B1 * | 5/2002 | Lin | F21S 10/00 362/294 |
| 6,454,441 | B1 * | 9/2002 | Lin | F21S 10/00 362/294 |
| 6,513,945 | B1 | 2/2003 | Wyss et al. | |
| 8,496,346 | B2 | 7/2013 | Zinox | |
| 2014/0183326 | A1 * | 7/2014 | Ples | A63H 3/006 248/550 |
| 2016/0109094 | A1 | 4/2016 | Magras-Sinnen et al. | |

* cited by examiner

*Primary Examiner* — Thomas M Sember

(74) *Attorney, Agent, or Firm* — Cozen O'Connor

(57) ABSTRACT

A novelty display for use with a housing having a light source arranged so that light from the light source emanates through the top, the display including: a support member having: an anchoring end configured to affix to the rear face of the housing; a display end to be illuminated by the light source through the top; and a middle section extending between the anchoring end and the display end. The middle section extends from the anchoring end away from the rear face and back toward the display end above the top. A first portion of the middle section is obscured when viewing the display from the front, and a second portion of the middle section not obscured by the housing or the display end is configured to minimize its visibility in the dark, to provide the illusion of the display end levitating above the open top of the housing.

12 Claims, 5 Drawing Sheets

DISPLAY KIT

CROSS-REFERENCE TO RELATED APPLICATION

This application claims benefit under 35 U.S.C. 119(e) of U.S. Provisional Patent application No. 62/584,567, filed Nov. 10, 2017, the entirety of which is hereby incorporated by reference herein.

BACKGROUND OF THE INVENTION

1. Field of the Invention

This present invention relates to an illuminated novelty display for an item, such as a pumpkin.

2. Related Art

Traditional novelty displays for decorating and/or lighting pumpkins (e.g., jack-o-lanterns) require human interaction with sharp, bladed instruments, a significant investment of time and energy, and can be quite messy as small shards and scraps of carved pumpkin accumulate throughout the process.

One known device, shown in U.S. Pat. No. 8,496,346 to Zinox, illuminates the inside of a pumpkin, gourd or the like, by introducing an electric lighting device, formed in the shape of a hat, into a cavity at the top of pumpkin that has been cut into a jack-o-lantern configuration. This technique requires a digging out of a large portion of the interior of the pumpkin to insert the lighting portion of the device, and any decoration is by the hat itself, and/or a traditional carving, with the disadvantages mentioned above.

In addition to the above-mentioned difficulties, while such a device provides a lighting feature to the pumpkin, it is very clear to a viewer that it is simply a hat-shaped lantern inserted into the top of the pumpkin. Thus, while the device provides lighting, it does not provide any mesmerizing effect; it simply appears as a device attached to the pumpkin.

SUMMARY OF THE INVENTION

The present invention is directed to a novelty display that provides the illusion of a levitating decoration position positioned above an illuminated top of a pumpkin.

In accordance with an aspect of the invention, a novelty display for use with a housing having a bottom, a top, a front face for viewing by a viewer of the display and a rear race opposite the front face, the housing having a light source arranged in relation to the housing so that light from the light source emanates through the top, includes: a support member having: an anchoring end configured to affix to the rear face of the housing along an anchor axis, the anchoring end being structured so as to limit rotation of the support about the anchor axis when the anchoring end is affixed to the housing; a display end to be illuminated by the light source through the top; and a middle section extending between the anchoring end and the display end, the middle section extending from the anchoring end away from the rear face of the housing to which the anchor is affixed and back toward the rear face of the housing, towards the display end at a location above the top, the support being configured so that a first portion of the middle section is obscured when viewing the display from the direction of the front face, and a second portion of the middle section that is not obscured by the housing or the display end is configured to minimize visibility of the second portion in the dark, to provide the illusion of the display end levitating above the open top of the housing.

In another aspect, the display end includes a support surface configured to support an object to be illuminated, the support surface arranged at a forward-most end of the support member, the support surface configured to receive the object to be illuminated; and the middle section includes: a first horizontal extension, extending, along the anchor axis, away from the location of the rear face of the housing at which the anchoring end is affixed, a first vertical extension extending upwardly in relation to the anchor axis from the first horizontal extension, and a second horizontal extension, extending horizontally from a top portion of the first vertical extension, towards the location above the top.

In another aspect, the first vertical extension extends upwardly from the second horizontal portion in the following order: a first oblique portion, a vertically oriented portion, and a second oblique portion.

In another aspect, the object to be illuminated is decorated with a holiday-themed indicia.

In another aspect, the support member comprises a spring portion, having sufficient rigidity to maintain an overall shape of the support member, and which is springingly flexible.

In another aspect, the support member is made of spring steel.

In another aspect, the housing comprises a pumpkin.

In another aspect, the anchoring end includes tines configured to affix to the rear face of the housing.

In another aspect, the anchoring end has a non-circular cross section.

In another aspect, the spring portion has a flat cross-sectional profile with a width greater than its height.

In another aspect, the support surface supports the object to be illuminated by adhesive attachment with the object.

In another aspect, the adhesive attachment uses hook and loop attachment.

In another aspect, the support surface supports the object to be illuminated with a clip attachment.

BRIEF DESCRIPTION OF THE DRAWINGS

Other objects and features of the present invention will become apparent from the following detailed description considered in conjunction with the accompanying drawings. It is to be understood, however, that the drawings are designed solely for purposes of illustration and not as a definition of the limits of the invention, which is defined by the claims appended hereto. It should be further understood that the drawings are not necessarily drawn to scale and that, unless otherwise indicated, they are merely intended to conceptually illustrate the structures and procedures described herein. In the drawings:

DETAILED DESCRIPTION OF THE PRESENTLY PREFERRED EMBODIMENTS

Figure 1A:
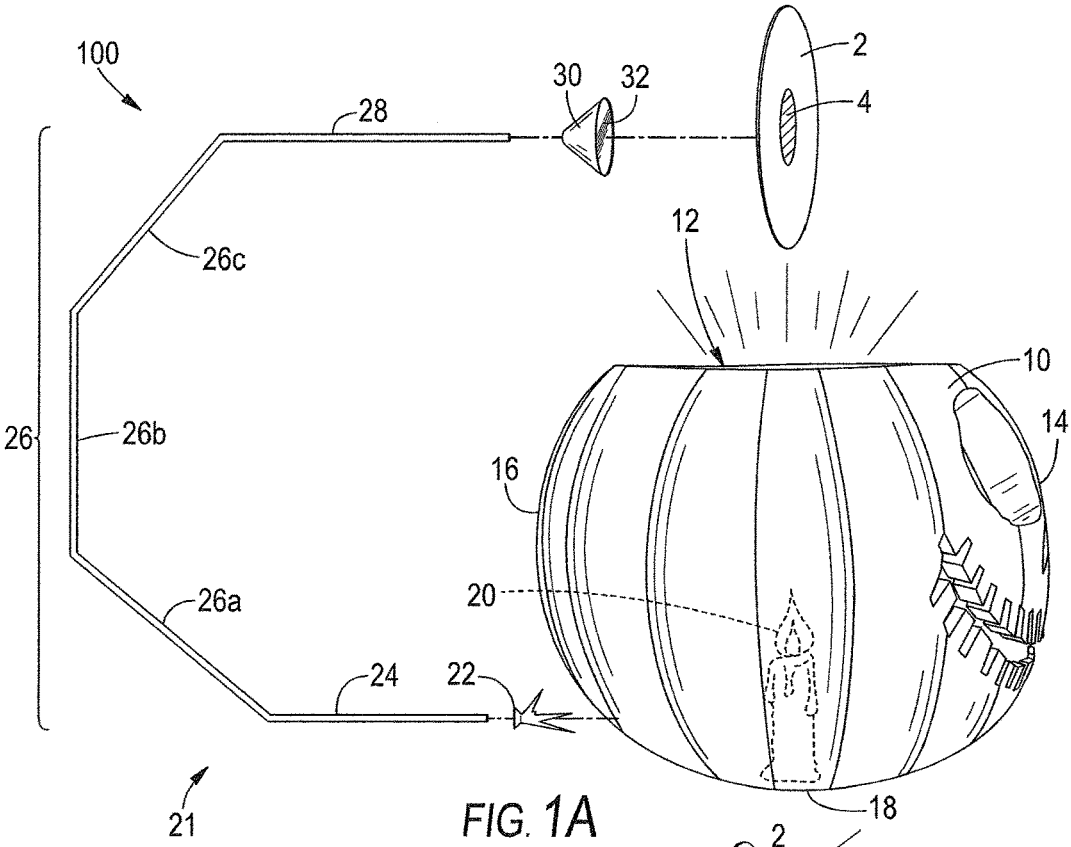
FIG. 1A is a view of the novelty display in relation to a housing with which the novelty display will be used, with the object to be illuminated not yet affixed to a support surface.
Figure 1B:
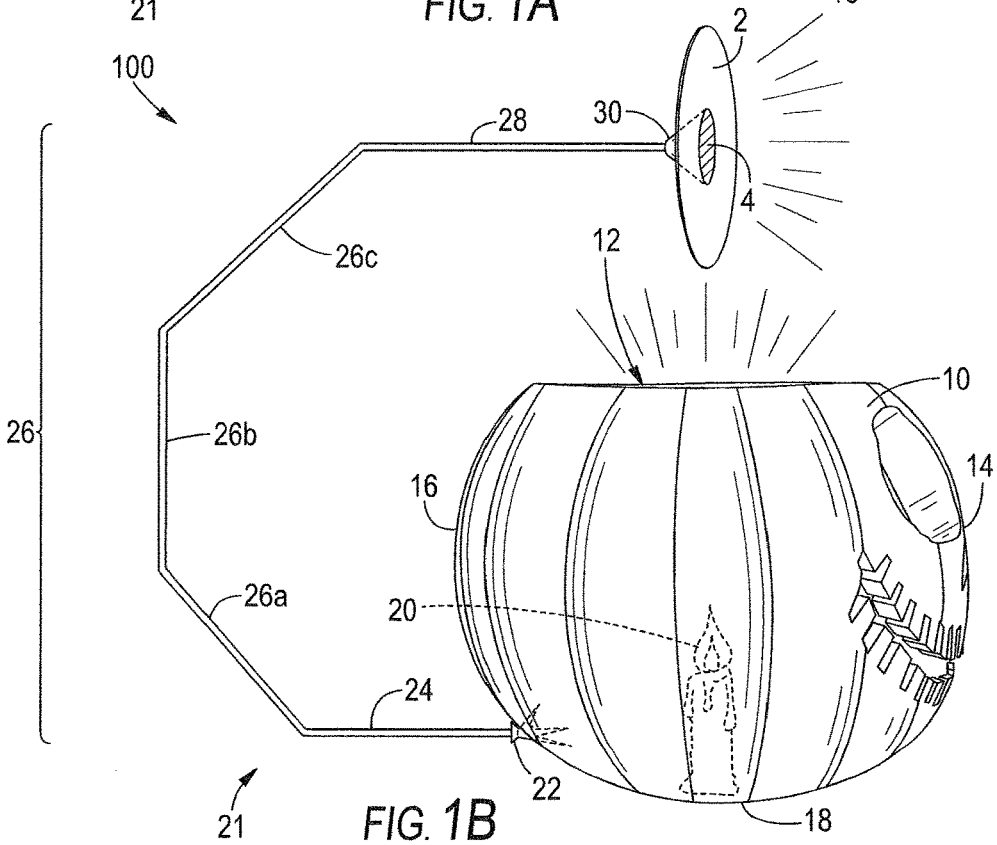
FIG. 1B is a view of the novelty display in relation to a housing with which the novelty display will be used, with the object to be illuminated affixed to the support surface.

FIGS. 1A and 1B are schematic illustrations of an illuminated novelty display showing the components thereof as well as the light source, a housing, and an object to be illuminated. It will be recognized that in most cases, the object to be illuminated (hereinafter "the object") will be a decorative item, such as a disk or otherwise patterned item having an image printed or otherwise affixed thereon, or configured as an image, such as a cut-out shape, however the invention is not limited to such an embodiment and, for example, the object to be illuminated may be an integral part of the display itself.

As will be discussed in detail below, the novelty display of the present invention permits a user to decorate a housing, such as a pumpkin/jack-o-lantern, and wherein the object to be illuminated is maintained in a position in relation the housing so that it appears, from a viewing direction, that the object is levitating unsupported above the housing, with the components of the novelty display not visible to the viewer, at least at night, or in a darkened enclosure such as a dark room. The object would typically be a cardboard cutout or plastic member, with a holiday-themed indicia, e.g., a decoration, such as a skull for Halloween.

As shown in FIGS. 1A and 1B, in a first embodiment the object 2 is a pattern that will be subject to illumination by a light source 20, the light source 20 being preferably located inside the housing 10. In a typical case the housing 10 will be a pumpkin or other vegetable that has had a central interior volume carved out of it to produce a hollow chamber. The light source 20, such as a candle or electric light, in a preferred embodiment, is arranged inside the carved (or hollowed) out volume in the housing 10. Of course, if the housing is artificial, such as a plastic pumpkin, the light would be arranged, e.g., in the already hollow interior.

The housing has a top 12, which, in one embodiment, comprises a hole cut out at the stem portion of the pumpkin. The light source 20 illuminates light out through the top 12.

The housing 10 also includes a front face 14, facing in the direction of intended viewers, a rear face 16 opposite the front face 14, and a bottom 18.

To achieve the desired display effect, in the illustrated embodiments the object 2 is suspended above the cutout portion 12 such that the illumination light from the light source 20 illuminates the object 2. This is achieved by the use of the novelty display support 100 in accordance with the present invention, as will described in further detail below.

The support 100 includes a member 21, such as a bent or malleable wire, an anchoring end ("anchor") 22 and a display end forming an object support 30, which itself has a support surface 32. While FIGS. 1A and 1B illustrate the member 21 being a component distinct from the anchor 22 and the object support 30, the invention is not limited to this configuration. That is, the member 21 can also be integrally formed with one or both of the anchor 22 and the object support 30 to form the support 100.

The member 21 has a first horizontal extension 24, extending horizontally away from the anchor 22, that is, horizontally away from the portion of the housing 10 in which the anchor 22 is attached to the housing 10.

The member 21 has a vertical extension 26 that extends upwardly, either straight upwardly, with two diagonal sections 26*a* and 26*c* surrounding a strictly vertical section 26*b*, as shown in the exemplary figures, or in an arcuate fashion, such as a "C-shape" formation.

In the illustrated embodiment, the vertical extension 26 extends upwardly until it reaches a level approximately level with the height level at which the object is to be displayed, at which point the vertical extension 26 ends and the member 21 bends again to form a second horizontal extension 28. As can be seen from the figures, the second horizontal extension 28 extends in a forward horizontal direction, that is, in the direction of the intended viewer, until it meets, or becomes, the object support 30.

It is important that the second horizontal extension 28 extends such that when viewing the object from the front, i.e., the intended direction of the viewer, the extension 28 is hidden, i.e., obscured by, the object. It is also important that the member 21 be finished with a dark matte finish, so that even the vertical extension 26, which is not obscured by the object 2, is difficult to see from the front of the housing 10, particularly in the dark.

Once the anchor 22 is attached to the housing 10, and the object 2 is attached to the object support 30, the display is ready for use. Of course, the decoration forming the object to be illuminated can be integrally formed with the object support 30.

Figure 2A:
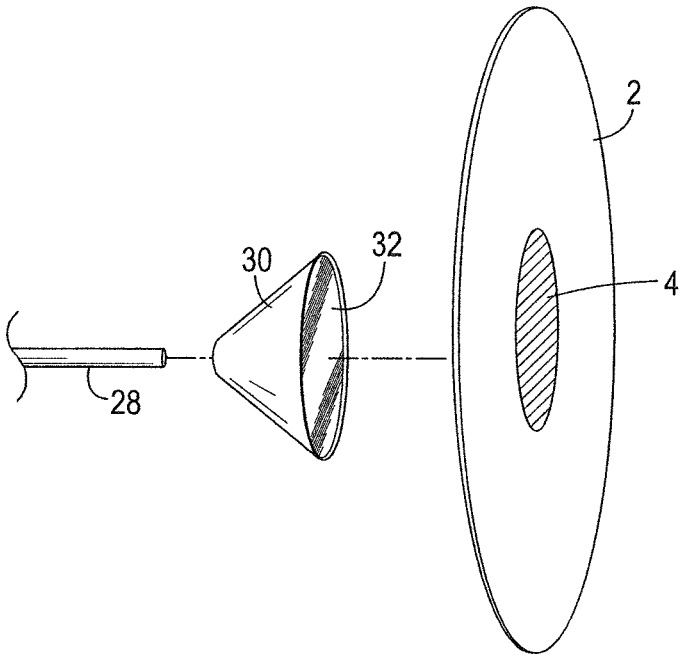
FIG. 2A is an expanded view of the area in which the support surface contacts the object to be illuminated.
Figure 2B:
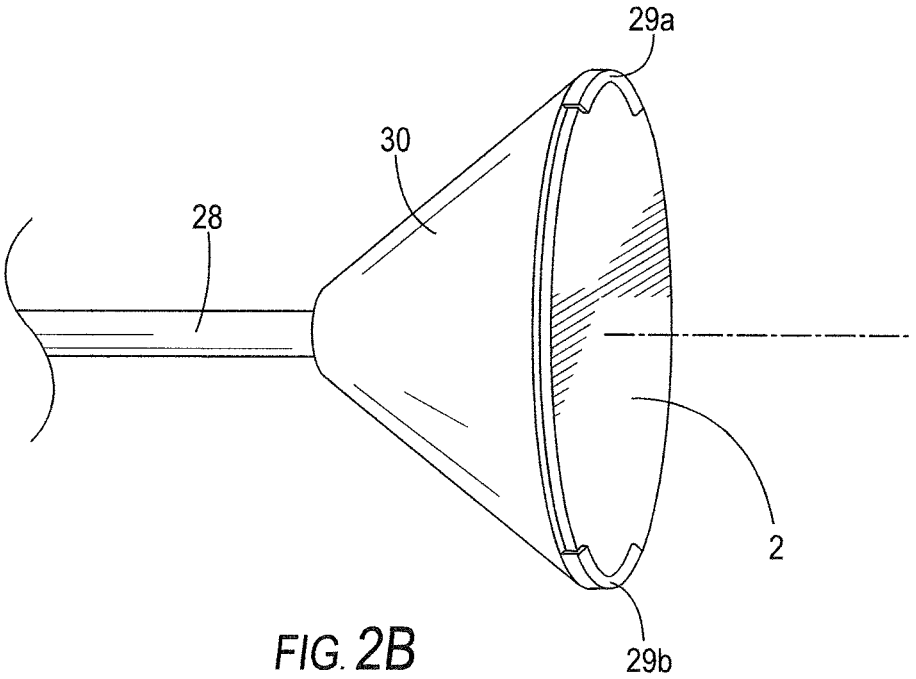
FIG. 2B is view of an embodiment in which the support surface includes a clip for holding the object to be illuminated.

FIGS. 2A and 2B show two embodiments of the connection between the object support 30 and the object 2 at a support end of the support 100. In the first embodiment, shown in FIG. 2A, the object 2 has adhesive 4. In this embodiment, the object 2 is configured to be connected via the adhesive to a supporting surface 32 of the object support 30. The supporting surface 32 is preferably flat and of the same or similar dimensions as that of the adhesive 4. To form the display, the supporting surface 32 is pressed to the adhesive until the adhesive adheres these components together. Alternatively, the adhesive connection can be by a hook and loop connection (see FIG. 3C).

In the second embodiment, shown in FIG. 2B, the object 2 is held by the object support 30 in channel-forming portions 29*a* and 29*b*, in which a user may slidably engage the object 2 with the object support 30. Although two channel-forming portions (upper and lower) are illustrated, only the bottom one 29*b* is necessary to hold an object, such as a rounded flat cardboard decorated item, in place. When two channel-forming elements are used, the object can be slightly bent to angle its edges in place in the support. The invention is not limited to the adhesive or the clip manner of attaching the object 2 to the object support 30, and any method can used that allows an object, such as a decorative piece of cardboard or the like, to be held at a position at the support end of the support 100, over the top opening of the housing. Moreover, to mount a square or rectangular shaped object, the clips would be straight, rather than curved as shown in FIG. 2B.

Figure 3:
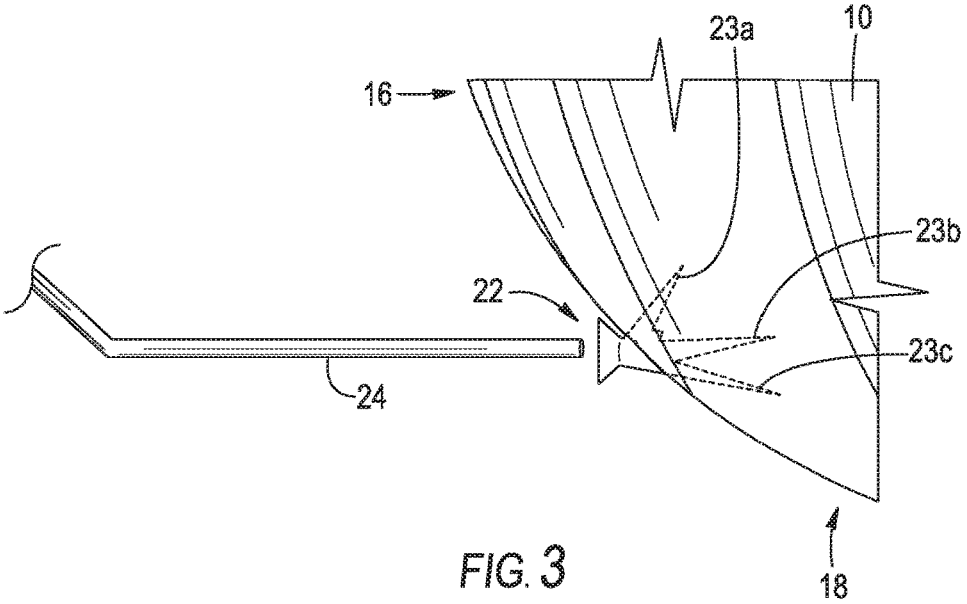
FIG. 3 is an expanded view of the area in which the anchor is affixed to the lower rear portion of the housing.
Figure 3A:
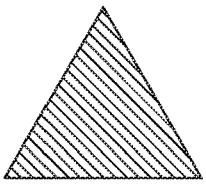
FIG. 3A is an alternative cross section of the anchor.
Figure 3B:
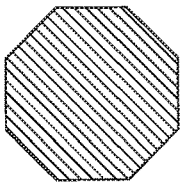
FIG. 3B is another alternative cross section of the anchor.
Figure 3C:
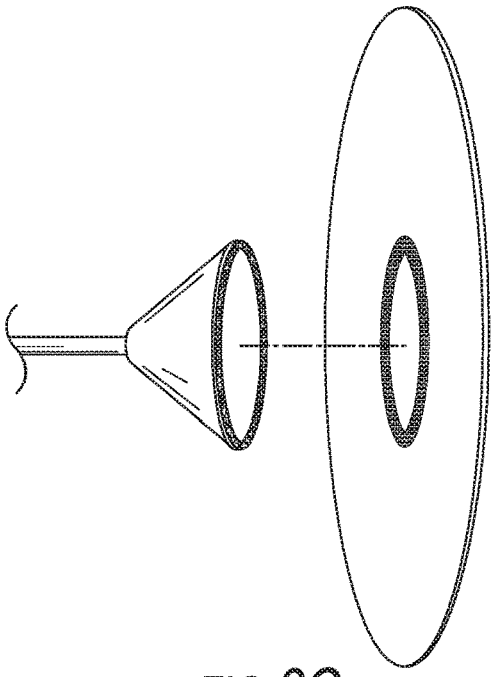
FIG. 3C shows a hook and loop fastener connection between the display and the object.

FIG. 3 is a magnified view of the anchor 22 engaging an area of the housing 10 between the bottom portion 18 and the rear portion 16. Preferably the anchor 22 includes tines 23*a* through 23*c* to ensure that twisting does occur around the anchoring axis. The number of tines is not limited to three, and may be more or only two tines. This same effect can also be achieved by using an anchor having a triangular (see FIG. 3A), square, hex (see FIG. 3B), or other non-circular cross-sectional profile. The important thing, regarding the number of tines, or the cross-sectional profile, is to prevent or at least inhibit rotation of the anchor 22 about the axis of its engagement with the housing 10. In FIG. 3, the anchor 22 is shown, in exploded view fashion, as being a distinct component from the first horizontal extension 24. In such an embodiment, the extension 24 would mate, via soldering, welding, adhesive, or the like, with the anchor 22 to produce this end of the support 100. Whether integrally formed or made of separate pieces, this portion of the support is an anchoring end of the support 100.

The same is true of the object support 30 and the second horizontal extension 28, which extension, if not integrally formed together with the object support 30, would have to mate, via soldering, welding, adhesive, or the like, with the object support 30 to produce the other end of the support 100, proximate the object 2.

Preferably, the object 2, when affixed to the object support 30, is positioned with a clearance above the top cutout 20, by virtue of the dimensions of the member 21. That is, the member is dimensioned and configured such that, when the anchor 22 is engaged in the housing 10, and the object support 30 is engaged with the object 2, the object 2 is positioned above the top 20 such that light from the light source 20 illuminates the object.

The member 21 is preferably made of a metal that is rigid enough to maintain its shape under quiescent conditions, but which is springy enough to slightly move up and down if tapped, or in reaction to a breeze, for example. Thus, the member should preferably be formed from spring steel or a similar metal. Alternatively, the member could be made of a plastic or other synthetic material that has the same characteristics described above.

The member 21 would typically be a relatively flat profiled wire, i.e., having a cross-sectional width greater than its height, although a wire of a different, for example oval or circular, cross section can be utilized as well if has sufficient stiffness.

Figure 4:
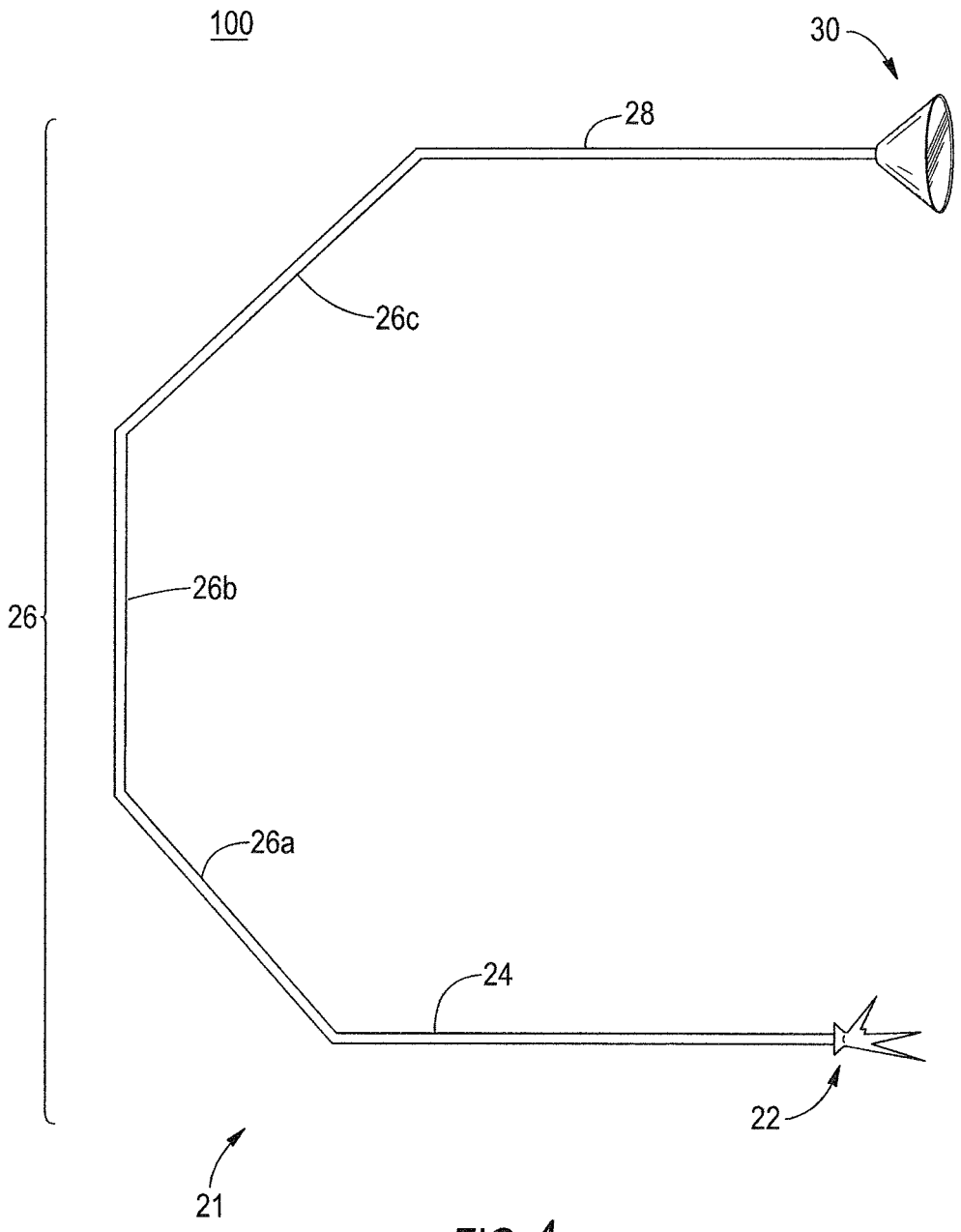
FIG. 4 shows the support in accordance with an embodiment of the present invention.

FIG. 4 is a view of an assembled support 100, with the anchor 22 attached to the first horizontal extension 24 and the object support 30 attached to the second horizontal extension 28.

Figure 5:
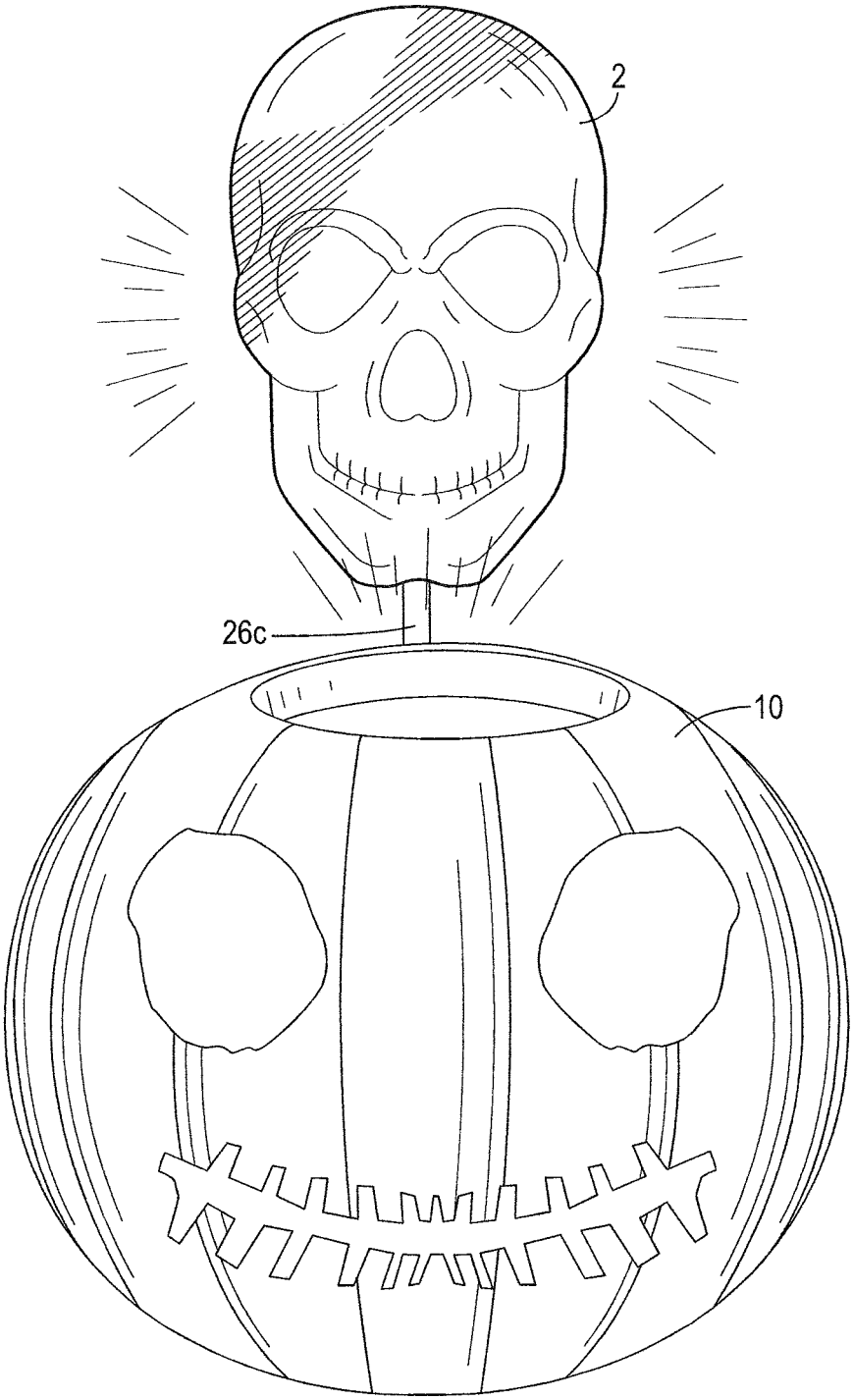
FIG. 5 is shows a view of the novelty display with the object illuminated and arranged such that the object appears to be levitating unsupported over the top of the housing.

FIG. 5 is a view of the assembled novelty display according to an aspect of the present invention showing a decoration on the front portion of the object 2, from the point of view of the intended viewer, configured so that the object 2 apparently levitates above a pumpkin/jack-o-lantern as the housing 10. It is noted that the decorated object 2 is illuminated from below by the light source 20, not visible in this view. Also, due to the fact that the second horizontal extension 28 extends directly back from the object 2, and the fact that the member 21 has a dark, preferably black matte finish, the object 2 appears to be, at least in a darkened environment, levitating above the pumpkin/jack-o-lantern without support. It is noted that due to the flexibility of the member 21, if the display is placed outdoors and subject to breeze, or indoors and near a fan, the object 2 will slightly rise and fall, increasing the mesmerizing effect of the display.

By virtue of the embodiments discussed above, a mesmerizing and fun novelty display can be created that provides the illusion of a levitating, illuminated, face or other decoration above a housing, such as a jack-o-lantern.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed is:

1. A novelty display for use with a housing having a bottom, a top, a front face for viewing by a viewer of the display and a rear face opposite the front face, the housing having a light source arranged in relation to the housing so that light from the light source emanates through the top, the display comprising:

a support member having:

an anchoring end configured to affix to the rear face of the housing along an anchor axis, the anchoring end being structured so as to limit rotation of the support about the anchor axis when the anchoring end is affixed to the housing;

a display end to be illuminated by the light source through the top; and a middle section extending between the anchoring end and the display end, the middle section extending from the anchoring end away from the rear face of the housing to which the anchor is affixed and back toward the rear face of the housing, towards the display end at a location above the top, the support being configured so that a first portion of the middle section is obscured when viewing the display from a direction of the front face, and a second portion of the middle section that is not obscured by the housing or the display end is configured to minimize visibility of the second portion in the dark, to provide the illusion of the display end levitating above the open top of the housing.

2. The novelty display according to claim 1, wherein:

the display end comprises a support surface configured to support an object to be illuminated, the support surface arranged at a forward-most end of the support member, the support surface configured to receive the object to be illuminated; and the middle section comprises:

a first horizontal extension, extending, along the anchor axis, away from the location of the rear face of the housing at which the anchoring end is affixed, a first vertical extension extending upwardly in relation to the anchor axis from the first horizontal extension, and a second horizontal extension, extending horizontally from a top portion of the first vertical extension, towards the location above the top.

3. The novelty display according to claim 2, wherein the first vertical extension extends upwardly from the second horizontal portion in the following order: a first oblique portion, a vertically oriented portion, and a second oblique portion.

4. The novelty display according to claim 2, wherein the object to be illuminated is decorated with a holiday-themed indicia.

5. The novelty display according to claim 1, wherein the support member comprises a spring portion, having sufficient rigidity to maintain an overall shape of the support member, and which is springingly flexible.

6. The novelty display according to claim 5, wherein the support member is made of spring steel.

7. The novelty display according to claim 1, wherein the housing comprises a pumpkin.

8. The novelty display according to claim 1, wherein the anchoring end includes tines configured to affix to the rear face of the housing.

9. The novelty display according to claim 1, wherein the anchoring end has a non-circular cross section.

10. The novelty display according to claim 2, wherein the support surface supports the object to be illuminated by adhesive attachment with the object.

11. The novelty display according to claim 10, wherein the adhesive attachment uses hook and loop attachment.

12. The novelty display according to claim 2, wherein the support surface supports the object to be illuminated with a clip.

* * * * *